United States Patent [19]

Elkington et al.

[11] 4,082,145

[45] Apr. 4, 1978

[54] DETERMINING THE LOCUS OF A PROCESSING ZONE IN AN IN SITU OIL SHALE RETORT BY SOUND MONITORING

[75] Inventors: W. Brice Elkington, Grand Junction, Colo.

[73] Assignee: Occidental Oil Shale, Inc., Grand Junction, Colo.

[21] Appl. No.: 798,076

[22] Filed: May 18, 1977

[51] Int. Cl.[2] ..... E21B 43/24; E21B 45/00; E21B 47/12

[52] U.S. Cl. ..... 166/251; 299/2

[58] Field of Search ..... 166/251, 250, 252, 256, 166/272, 254; 299/2; 181/101, 102

[56] References Cited

U.S. PATENT DOCUMENTS

| | | | |
|---|---|---|---|
| 2,305,384 | 12/1942 | Hoover, Jr. et al. | 181/101 X |
| 2,803,305 | 8/1957 | Behning et al. | 166/251 |
| 3,001,776 | 9/1961 | Van Poollen | 299/2 |
| 3,031,762 | 5/1962 | Parker | 166/251 X |
| 3,172,467 | 3/1965 | Trantham et al. | 166/251 X |
| 3,467,189 | 9/1969 | Dingley | 166/251 |
| 3,483,730 | 12/1969 | Gilchrist et al. | 166/251 X |
| 3,586,377 | 6/1971 | Ellington | 299/2 X |
| 3,661,423 | 5/1972 | Garret | 299/2 |
| 3,974,476 | 8/1976 | Cowles | 181/102 X |

OTHER PUBLICATIONS van Poollen, "Transient Tests Find Fire Front in an In Situ Combustion Project", The Oil and Gas Journal, vol. 63, No. 5, 2/1/65 pp. 78–80, 166–251.

*Primary Examiner*—Stephen J. Novosad
*Attorney, Agent, or Firm*—Christie, Parker & Hale

[57] ABSTRACT

The locus of a processing zone advancing through a fragmented permeable mass of particles in an in situ oil shale retort in a subterranean formation containing oil shale is determined by monitoring for sound produced in the retort, preferably by monitoring for sound at at least two locations in a plane substantially normal to the direction of advancement of the processing zone. Monitoring can be effected by placing a sound transducer in a well extending through the formation adjacent the retort and/or in the fragmented mass such as in a well extending into the fragmented mass.

31 Claims, 2 Drawing Figures

Figure 1:
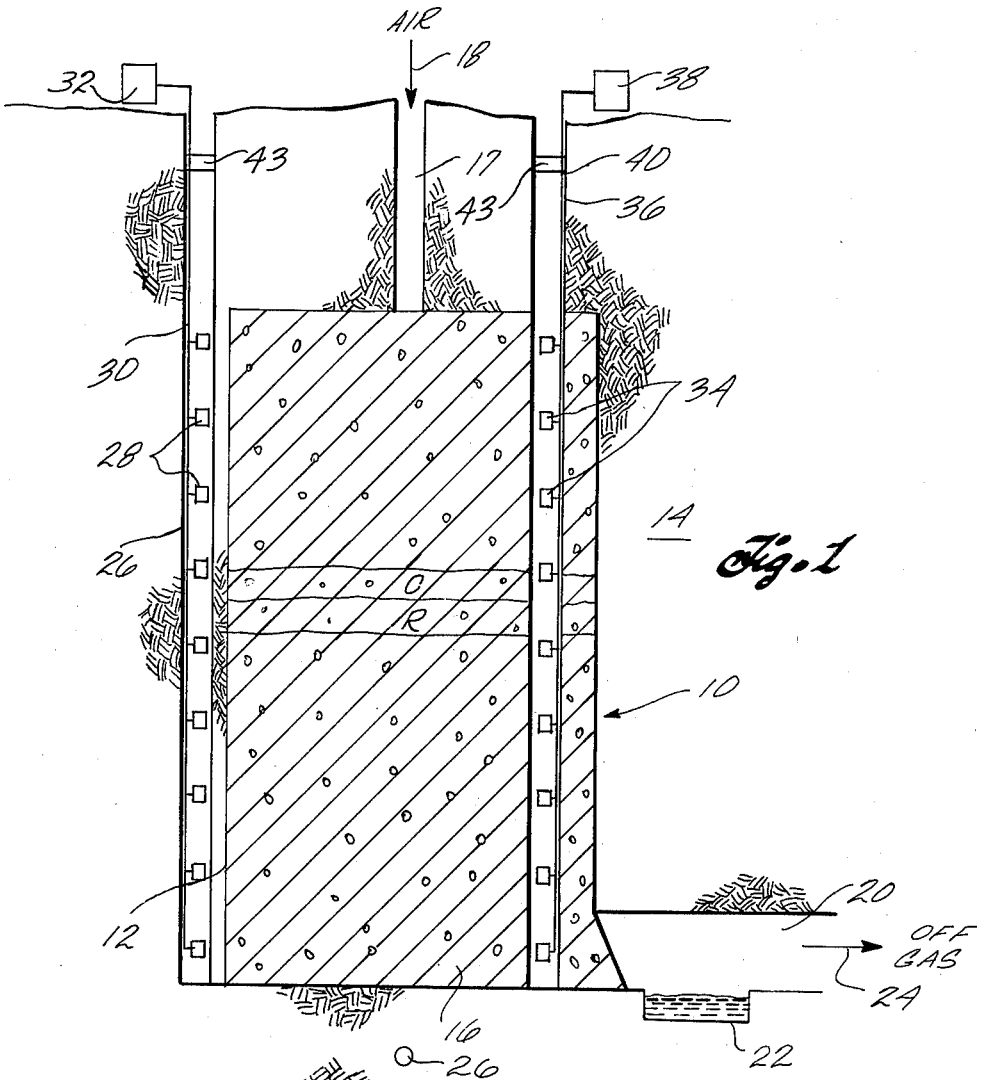

DETERMINING THE LOCUS OF A PROCESSING ZONE IN AN IN SITU OIL SHALE RETORT BY SOUND MONITORING

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which upon heating decomposes to produce liquid and gaseous hydrocarbon products. It is the formation containing kerogen tht is called "oil shale" herein, and the liquid hydrocarbon product is called "shale oil".

A number of methods have been proposed for processing the oil shale which involve either first mining the kerogen bearing shale and processing the shale above ground, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by this reference. This patent describes in situ recovery of liquid and gaseous hydrocarbon materials from a subterranean formation by fragmenting such formation to form a stationary, fragmented, permeable mass of formation particles containing oil shale within the formation, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of a gaseous combustion zone feed comprising oxygen downwardly into the combustion zone to advance the combustion zone downwardly through the retort. In the combustion zone oxygen in the gaseous combustion zone feed is depleted by reaction with hot carbonaceous materials to produce heat and combustion gas. By the continued introduction of the combustion zone feed downwardly into the retort, the combustion zone is advanced downwardly through the retort.

The effluent gas from the combustion zone comprises combustion gas and any gaseous portion of the combustion zone feed that does not take part in the combustion process. This effluent gas is essentially free of free oxygen and contains constituents such as oxides of carbon and sulfurous compounds. It passes through the fragmented mass in the retort on the advancing side of the combustion zone to heat the oil shale in a retorting zone to a temperature sufficient to produce kerogen decomposition, called retorting, in the oil shale to gaseous and liquid hydrocarbon products and to a residue of solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort and withdrawn to the surface through an access tunnel, drift or shaft. An off gas containing combustion gas generated in the combustion zone, gaseous products produced in the retorting zone, gas from carbonate decomposition, and any gaseous portion of combustion zone feed that does not take part in the combustion process is also withdrawn from the bottom of the retort to the surface.

It is desirable to know the locus of parts of the combustion and retorting processing zones as they advance through an in situ oil shale retort for many reasons. One reason is that by knowing the locus of the combustion zone, steps can be taken to control the orientation of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed combustion zone, more cracking of the hydrocarbon products can result. Monitoring the locus of the combustion zone provides information for control of the advancement of the combustion zone to maintain it flat and uniformly perpendicular to the direction of its advancement to obtain high yield of hydrocarbon products.

Another reason for monitoring the locus of the combustion zone is so that the composition of the combustion zone feed can be varied with variations in the kerogen content of the oil shale being retorted. If combustion zone feed containing too high a concentration of oxygen is introduced into a region of the retort containing oil shale having a high kerogen content, oxidation of carbonaceous material in the oil shale can generate so much heat that fusion of the oil shale can result. High temperatures also can cause excessive endothermic carbonate decomposition to carbon dioxide and dilution of the off gas from the retort, thereby lowering the heating value of the off gas. Layers in the fragmented mass are correlated with strata in the unfragmented formation because there is little vertical mixing between strata when explosively fragmenting formation to form a fragmented permeable mass of formation particles. Therefore, samples of various strata through the retort can be taken before initiating retorting of the oil shale and assays can be conducted to determine the kerogen content. Then, by monitoring the locus of the combustion zone as it advances through the retort, the composition of the combustion zone feed can be appropriately modified.

Another reason for monitoring the locus of the combustion and retorting processing zones as they advance through the retort is to monitor the performance of the retort to determine if sufficient shale oil is being produced for the amount of oil shale being retorted.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon products.

Thus, it is desirable to provide a method for monitoring advancement of combustion and retorting processing zones through an in situ oil shale retort.

SUMMARY OF THE INVENTION

The present invention concerns a process for determining the locus of a processing zone such as a combustion zone advancing through a fragmented permeable mass of particles in an in situ oil shale retort in a subterranean formation containing oil shale. The method comprises the step of monitoring for sound produced in the retort. Preferably sound is monitored at at least two locations, and more preferably at at least three locations, in a plane substantially normal to the direction of advancement of the processing zone through the fragmented mass to determine if the processing zone is flat and uniformly transverse to its direction of advancement.

Monitoring can be effected by placing one or more sound transducers in a conduit extending into the fragmented mass and/or in a well extending through the formation adjacent the retort. Also, a sound transducer can be placed directly into the fragmented mass. A plurality of sound transducers can be placed at a plurality of selected locations spaced apart from each other or a single sound transducer can be moved to a plurality of locations within a conduit or well to track a processing zone as it advances through a retort.

The sound transducers are sensitive to sound intensity and sounds characterizing a combustion zone and/or a retorting zone for distinguishing them from each other and for distinguishing their sounds from those produced in other portions of an in situ oil shale retort. Monitoring such characteristic sounds provides a way of determining the locus of a processing zone in an in situ oil shale retort. For determining the locus of a combustion zone, the sound transducers can be sensitive to sound at a frequency characteristic of sound produced by burning of hydrocarbons.

DRAWINGS

Figure 2:
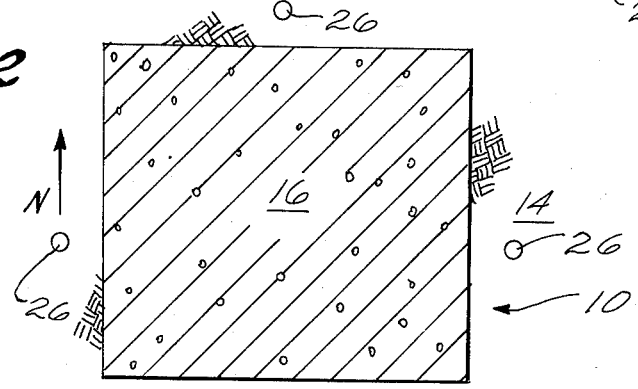

These and other features, aspects and advantages of the present invention will become more apparent upon consideration of the following description, appended claims and accompanying drawings where:

FIG. 1 schematically represents in vertical cross section an in situ oil shale retort having means for monitoring sound produced in the retort; and FIG. 2 schematically represents in horizontal cross section an in situ oil shale retort having means for monitoring sound produced in the retort.

DESCRIPTION

Referring to FIG. 1, an in situ oil shale retort 10 is in the form of a cavity 12 formed n an unfragmented subterranean formation 14 containing oil shale. The cavity contains a fragmented permeable mass 16 of formation particles containing oil shale. The cavity 12 can be created simultaneously with fragmentation of the mass of formation particles 16 by blasting by any of a variety of techniques. A desirable technique involves excavating a void within the in situ oil shale retort site and explosively expanding remaining oil shale in the site toward such a void. A method of forming an in situ oil retort is described in U.S. Pat. No. 3,661,423. A variety of other techniques can also be used.

A conduit 17 communicates with the top of the fragmented mass of formation particles. During the retorting operation of the retort 10, a combustion processing zone C is established in the retort and advanced by introducing as a combustion zone feed a retort inlet mixture containing an oxygen supplying gas, such as air 18 or air mixed with other gases, into the in situ oil shale retort through the conduit 17 as a combustion zone feed. Oxygen introduced to the retort in the retort inlet mixture oxidizes carbonaceous material in the oil shale to produce combustion gas. Heat from the exothermic oxidation reactions, carried by flowing gases, advances the combustion zone through the fragmented mass of particles.

Combustion gas produced in the combustion zone and any gaseous unreacted portion of the combustion zone feed pass through the fragmented mass of particles on the advancing side of the combustion zone to establish a retorting processing zone R on the advancing side of the combustion zone. Kerogen in the oil shale is retorted in the retorting zone to produce liquid and gaseous products.

There is an access tunnel, adit, drift 20 or the like in communication with the bottom of the retort. The drift contains a sump 22 in which liquid products are collected to be withdrawn for further processing. An off gas 24 containing gaseous products, combustion gas, gas from carbonate decomposition, and any gaseous unreacted portion of the combustion zone feed is also withdrawn from the in situ oil shale retort 10 by way of the drift 20.

During the retorting operation the fragmented permeable mass of particles 16 undergoes thermal stresses due to temperature changes. Initially a particle in the fragmented mass is at ambient temperature. The particle is gradually heated to the temperature of the retorting zone, which can be as high as about 1100° F, and eventually the particle attains the temperature of the combustion zone, which can be up to the fusion temperature of oil shale, which is about 2100° F, although it is preferably appreciably lower. Subsequently, as the combustion zone further advances through the retort beyond the particle, the particle is cooled by the retort inlet mixture.

This heating of a particle as the combustion zone approaches and subsequent cooling of the particle after the combustion zone has passed can cause uneven expansion and contraction of the particle resulting in thermal stresses in the particle. These thermal stresses can result in cracking and exfoliation accompanied by characteristic sounds.

Another process occuring in a retort which can result in production of sound is burning of hydrocarbons in the combustion zone. It is known that when hydrocarbons are burned, they can produce characteristic sounds detectable at a frequency of about 125 hertz, and at its harmonics of about 250 hertz and about 500 hertz.

Other processes occurring in the retorting and combustion zones which can result in production of sound include release of volatilized hydrocarbons by decomposition of kerogen in the oil shale and release of carbon dioxide due to decomposition of alkaline earth metal carbonates such as calcium and magnesium carbonates present in oil shale. These thermally induced reactions cause volume changes in the oil shale and gaseous products induce stresses associated with diffusion through the oil shale. Retorted and combusted oil shale is found to have appreciable swelling and secondary cracking. It is known that cracking and spallation of rock are accompanied by distinctive sounds. Monitoring is, therefore, provided for detecting sounds of characteristic amplitude, frequency, rise time and the like, occurring in the retorting and/or combustion processing zones of the retort where the thermally and chemically induced stresses are greatest.

The locus of the combustion zone C and/or retorting zone R as they advance through the fragmented permeable mass of particles, is monitored by the sounds they produce in the retort 10. Monitoring can be effected by placing one or more sound transducers in and/or adjacent to the retort at selected locations.

For example, referring to FIG. 1, in a first version of this invention a well 26 such as a cased or an uncased bore hole extends vertically through the formation 14 adjacent the fragmented permeable mass 16 in the retort 10. Within the well are a plurality of sound transducers 28 vertically spaced apart from each other. The transducers convert sound to an electrical output. Each of the transducers is connected to electrical signal transfer means such as a multi-signal lead cable 30 connected to monitoring means 32 above ground. The locus of the combustion or retorting zone is monitored by noting signals from the transducers 28 having a frequency, amplitude and/or rise time corresponding to that produced by the combustion or retorting zone.

The sound transducers used can be devices such as microphones or piezoelectric crystals having sufficient sensitivity to detect sounds produced in the retort.

Preferably the well 26 is drilled or otherwise provided through unfragmented formation 14 at a distance of from about 4 to about 8 feet from the fragmented mass 16 in the retort 10. At a distance greater than about 8 feet, sound produced in the retort can be so attenuated by the insulating effect of unfragmented formation that the sensitivity of this method for determining the locus of a processing zone can be adversely affected. Because of imprecision in accurately drilling bore holes and because of variations and irregularities in the wall of a retort, the bore hole is preferably at least about 4 feet from the fragmented mass in the retort to avoid drilling into the fragmented permeable mass when preparing the bore hole.

Also shown in FIG. 1 is a second version of this invention in which a plurality of vertically spaced apart sound transducers 34 are in a conduit 36 such as a cased bore hole extending into the fragmented permeable mass 16 of formation particles. The bore hole need not be cased in some embodiments. These transducers are also connected to monitoring means 38 above ground level by a multi-signal lead cable 40 extending through the well. An advantage of using a well or conduit extending into the fragmented mass is that the transducers can be placed close to the source of the sound, thereby permitting increased sensitivity to differences between sounds produced in different portions of the retort. When the transducers are in the fragmented permeable mass, it is necessary that the conduit, transducers, and leads be made of materials resistant to conditions in the retort. Such materials require resistance to high temperatures of the combustion zone and resistance to chemical attack by corrosive components of the gases present in the retort such as hydrogen sulfide and other sulfurous compounds.

An advantage of the first version of this invention where sound transducers ae provided in a bore hole 26 adjacent the retort which does not extend into the fragmented mass is that a low cost conduit or casing formed from low performance materials such as carbon steel can be used. This is because the high temperature, corrosive environment present in the retort is not present to the same degree in the formation adjacent the retort. Thus, the transducers and leads are not exposed to the corrosive environment in the retort. The instrument well adjacent the retort is preferred to avoid these conditions.

Monitoring in the bore hole 26 for sound from a processing zone in the retort is desirable since the transducers can be located in the formation out of reach of adverse conditions in the fragmented mass in the retort. Sound is transmitted through solid rock which may be relatively impervious to other indications of the locus of a processing zone in the retort.

Preferably the wells 26, 40 are provided by drilling after blasting to form the cavity 12 and fragmented mass 16 to prevent closure during blasting of the bore holes into which the transducers are placed. A gas impermeable barrier such as a packer 43 can be provided near the top of each well to prevent any gas which may leak into the well from the retort from passing into an area in which personnel are working.

As an alternative to placing the pressure transducers in a cased bore hole in the fragmented mass, transducers without a protective casing can be used. This can be effected by pulling the casing or by placing transducers within the boundaries of a retort to be formed prior to explosively expanding formation to form the fragmented mass. Such transducers must be able to survive such explosive expansion of formation.

It is believed that sound of maximum volume in the retort is produced in the combustion zone due to oxidation of hydrocarbons in the combustion zone. To determine the locus of a combustion zone advancing through a retort, the volume or intensity of sound produced in the retort can be monitored. An increase in the sound intensity monitored at a selected location indicates that the combustion zone is advancing toward that selected location. When the sound intensity at the selected location reaches a maximum, this indicates that the combustion zone has reached that selected location. Likewise, when the sound intensity monitored at that selected location decreses, this indicates that the combustion zone is advancing away from the selected location. It is believed that the technique of monitoring the maximum intensity of sound produced in a retort can be used to determine if a processing zone advancing through the retort is flat and uniformly normal to the direction of its advancement. This is because the maximum sound intensity measured by a transducer for a skewed processing zone is less than the maximum sound intensity measured by the same transducer for a processing zone which is normal to its direction in advancement. This occurs because a portion of a skewed processing zone can be beyond the transducer while at the same time a portion of the skewed processing zone can not yet have reached the transducer. On the other hand, when a processing zone which is flat and uniformly perpendicular to its direction of advancement reaches a processing zone, the entire processing zone is simultaneously as close as each portion of the processing zone can be to the transducer. Thus sound of greater intensity can be detected by a sound transducer with a processing zone normal to its direction of advancement than with a processing zone which is skewed.

When determining the locus of a combustion zone, it can be advantageous to monitor selected frequencies for sounds characteristic of the combustion zone. Since at least the bulk of hydrocarbons burned in the retort are burned in the combustion zone, it is believed that the bulk of sound produced in the retort at frequencies of about 125 hertz, about 250 hertz, and about 500 hertz occurs in the combustion zone. Thus by measuring sound volume at one or more of these selected frequencies, the locus of the combustion zone can be determined.

Preferably, sound produced in the retort is monitored at at least two locations spaced apart from each other in a plane substantially normal to the direction of advancement of a processing zone being monitored. That is, in the case of a processing zone advancing downwardly through a retort, preferably sound in the retort is monitored at at least two locations spaced apart from each other at a selected elevation. This permits determination of whether a processing zone advancing through a fragmented permeable mass is flat and uniformly transverse to its direction of advancement. If sound produced by the processing zone is detected by only a portion of the sound transducers at a selected elevation or if the transducers detect sound of different volumes, this indicates that the processing zone is skewed. if sound characteristic of the processing zone is detected simultaneously by two or more detectors at the same elevation or the same volume of sound is detected simultaneously by all transducers at the same elevation, this indicates that the processing zone is uniformly transverse to its direction of advancement.

More preferably, sound produced in the retort is monitored at at least three locations spaced apart from each other in a plane substantially normal to the direction of advancement of a processing zone because, according to geometrical principles, three points are required to define a plane. use of only two transducers may not provide enough information that a processing zone is skewed.

To provide at least two, and more preferably three sound transducers in a plane substantially normal to the direction of advancement of a processing zone, preferably at least two, and more preferably at least three bore holes are provided for monitoring sound. The bore holes can be spaced laterally apart within the fragmented mass, and/or as shown in FIG. 2, the bore holes 26 can be spaced apart around the perimeter of the fragmented mass.

As shown in FIG. 1, preferably sound produced in the retort is monitored at a plurality of selected locations spaced apart from each other along the direction of advancement of a processing zone through the fragmented mass such as by providing a plurality of transducers spaced apart from each other along the direction of advancement of the processing zone or by moving transducers. This permits tracking of the processing zone as it advances through the fragmented mass. When a processing zone is advancing downwardly or upwardly through the fragmented mass, sound transducers vertically spaced apart from each other can be provided.

Also as shown in FIG. 1, both sound transducers spaced apart from each other along the direction of advancement of a processing zone and sound transducers spaced apart from each other in a plane normal to the direction of advancement of a processing zone can be used in combination for determining if a processing zone is skewed and/or warped throughout the retorting process.

When a plurality of vertically spaced apart transducers are used in a single bore hole, it is preferred that the spacing between the transducers be no more than about the minimum thickness of the processing zone being monitored. This is to allow accurate determination of the locus of the processing zone as it advances downwardly through a retort. However, when advancing a combustion zone through oil shale having a high kerogen content, the combustion zone can be as narrow as 1 to 2 feet. In such a situation, providing sound transducers spaced apart at a distance from 1 to 2 feet for a retort which has a depth of hundreds of feet can be prohibitively expensive. If desired, useful data can be obtained by spacing the transducers a distance apart up to about 5 times the minimum thickness of an established combustion zone.

Using a method such as the method of this invention to monitor the locus of the combustion zone C advancing through the fragmented permeable mass 16 in the retort 10 has significant advantages. For example, steps can be taken to maintain the combustion zone flat and uniformly transverse to its direction of advancement to minimize oxidation and excessive cracking of hydrocarbons produced in the retorting zone. In addition, the rate of introduction and composition of the oxygen containing gas introduced into the combustion zone can be controlled to maintain the temperature in the combustion zone sufficiently low to avoid formation of excessive amounts of carbon dioxide and to prevent fusion of the oil shale. Furthermore, knowledge of the locus of the combustion and retorting zones as they advance through the retort allows monitoring the performance of a retort. Knowledge of the locus of the combustion and retorting zones also allows optimization of the rate of advancement to produce hydrocarbon products with the lowest expense possible by varying the composition of and introduction rate of the oxygen containing gas.

The following example demonstrates a method embodying features of this invention.

EXAMPLE

Referring to FIG. 2 a retort 10 containing a fragmented permeable mass 16 of formation particles containing oil shale was formed in the south/southwest portion of the Piceance Creek structural basin in Colorado. The retort was about 120 feet square in cross section and about 270 feet deep. The top of the retort was under an overburden of about 400 feet. Three bore holes 26, each 6 inches in diameter, are drilled from ground level to the elevation of the bottom of the retort through unfragmented formation on the east, west, and north sides of the retort. Each bore hole is drilled about six feet from the center point of a wall of the retort. To monitor sound in the retort, a microphone, preamplifier, cable, and filter are obtained from B&K Instruments (Breul & Kjar Instruments) of Cleveland, Ohio. A microphone having a 3 decibel response in the range of 22 hertz to 15,000 hertz and an IT-21P preamplifier are connected to each other and are placed in a bore hole. Seven hundred feet of Belden three conductor cable is attached to the preamplifier and used to move the preamplifier and microphone up and down through a bore hole and to withdraw the microphone and preamplifier from one bore hole for insertion into another bore hole. At ground level, a tape recorder is provided. Sound recorded on tapes with the tape recorder are played back through a Third Octave Filter Set, model 1616, and measured by an Impulse Precision Sound Level Meter, model 2209. A recorder is provided for recording the outputs of the sound meter.

Although this invention has been described in considerable detail with reference to certain versions thereof, other versions of this invention can be practiced. For example, although the invention has been described in terms of an in situ oil shale retort containing both a combustion processing zone and a retorting processing zone, it is possible to practice this invention with a retort containing only one processing zone, either a combustion or retorting zone. In addition, although the drawing shows a retort where the combustion and retorting zones are advancing downwardly through the retort, this invention is also useful for retorts where the combustion and retorting zones are advancing upwardly or transverse to the vertical.

Also, although the drawing shows a retort having a plurality of sound transducers, it can be useful to have only one transducer to limit the capital cost for monitoring. In this version of the invention, the location of a processing zone advancing through the retort can be approximated by monitoring for changes in a distinctive sound of the zone with the transducer in a fixed location, or the transducer can be moved through a well to scan sound at different elevations to find the locus of the processing zone.

Because of variations such as these, the spirit and scope of the appended claims should not be limited to the description of the preferred versions contained herein.

What is claimed is:

1. In a method for recovering gaseous and liquid products from an in situ oil shale retort in a subterranean formation containing oil shale, the in situ retort containing a fragmented permeable mass of particles containing oil shale and having a combustion processing zone and a retorting processing zone advancing downwardly therethrough, wherein the method comprises the steps of:

introducing into the in situ oil shale retort on the trailing side of the combustion processing zone a combustion zone feed comprising oxygen to advance the combustion processing zone downwardly through the fragmented mass of particles and produce combustion gas in the combustion processing zone;

passing combustion gas and any unreacted portion of the combustion zone feed through a retorting processing zone in the fragmented mass of particles on the advancing side of the combustion processing zone, wherein oil shale is retorted and gaseous and liquid products are produced;

withdrawing liquid products and a retort off gas comprising said gaseous products, combustion gas and any gaseous unreacted portion of the combustion zone feed from the in situ oil shale retort from the advancing side of the retorting processing zone;

the improvement comprising determining the locus of the combustion zone by (i) placing a plurality of sound transducers at a plurality of locations in the formation adjacent the fragmented mass and vertically spaced apart from each other, at least two of the selected locations being at about the same elevation and (ii) monitoring signals emitted by the transducers.

2. A method for determining the locus of a processing zone advancing through a fragmented permeable mass of particles in an in situ oil shale retort in a subterranean formation containing oil shale, the method comprising the step of monitoring for sound produced in the retort at at least two locations spaced apart from each other in a plane substantially normal to the direction of advancement of the processing zone through the fragmented mass.

3. The method of claim 2 in which the step of monitoring comprises monitoring sound intensity at a plurality of frequencies.

4. The method of claim 2 in which the step of monitoring comprises monitoring for sound produced in the retort at at least three selected locations spaced apart from each other in a plane substantially normal to the direction of advancement of the processing zone through the fragmented mass.

5. A method as claimed in claim 4 including the step of placing a sound transducer in each of three conduits extending into the fragmented mass for monitoring for sound produced in the retort.

6. A method as claimed in claim 4 including the step of placing a sound transducer in each of three wells extending through unfragmented formation adjacent the fragmented mass for monitoring for sound produced in the retort.

7. A method as claimed in claim 2 including the step of placing a sound transducer in at least one conduit extending into the fragmented mass for monitoring for sound produced in the retort.

8. A method as claimed in claim 2 including the step of moving a sound transducer to a plurality of selected locations spaced apart from each other along the direction of advancement of the processing zone through the fragmented mass for monitoring for sound produced in the retort.

9. A method as claimed in claim 8 in which the sound transducer is moved within a conduit extending into the fragmented mass.

10. A method as claimed in claim 8 in which the sound transducer is moved in a well extending through unfragmented formation adjacent the fragmented mass.

11. A method as claimed in claim 2 in which the step of monitoring comprises monitoring sound intensity.

12. A method as claimed in claim 11 in which the processing zone is a combustion zone and sound intensity is monitored at a frequency selected from the group consisting of about 125 hertz, about 250 hertz, about 500 hertz, and combinations thereof.

13. A method as claimed in claim 2 in which the processing zone is a combustion zone and sound intensity is monitored at a frequency characteristic of sound produced by burning of hydrocarbons.

14. A method as claimed in claim 2 in which the step of monitoring comprises monitoring for sound produced in the retort at a plurality of locations spaced apart from each other along the direction of advancement of the processing zone.

15. A method for determining the locus of a processing zone advancing through a fragmented permeable mass of particles in an in situ oil shale retort in a subterranean formation containing oil shale, the method comprising the step of monitoring for sound produced in the processing zone, wherein monitoring for sound is by at least one sound transducer within the fragmented mass.

16. The method of claim 15 in which the processing zone advances downwardly through the fragmented mass, and the step of monitoring comprises monitoring for sound produced in the retort at at least two locations spaced apart from each other and at about the same elevation.

17. The method of claim 15 in which the processing zone advances downwardly through the fragmented mass, and the step of monitoring comprises monitoring for sound produced in the retort at at least three locations spaced apart from each other and at about the same elevation.

18. A method as claimed in claim 15 including the step of placing a sound transducer in a conduit extending into the fragmented mass for monitoring for sound produced in the processing zone.

19. A method as claimed in claim 18 in which the processing zone advances downwardly through the fragmented mass and the conduit extends substantially vertically through the fragmented mass and including the step of moving such a sound transducer vertically within the conduit to a plurality of selected locations vertically spaced apart from each other for monitoring for sound produced in the processing zone.

20. A method as claimed in claim 15 in which the step of monitoring comprises monitoring sound intensity.

21. A method as claimed in claim 20 in which the processing zone is a combustion zone and the step of monitoring comprises monitoring sound volume at a frequency selected from the group consisting of about 125 hertz, about 250 hertz, about 500 hertz, and combinations thereof.

22. A method for determining the locus of a processing zone advancing through a fragmented permeable mass of particles in a subterranean formation containing oil shale, the method comprising the steps of:

drilling at least two bore holes extending through unfragmented formation adjacent the fragmented mass; and monitoring within each of the bore holes for sound produced in the retort.

23. A method as claimed in claim 22 in which the step of monitoring comprises monitoring sound intensity.

24. A method as claimed in claim 23 in which the processing zone is a combustion zone and the step of monitoring comprises monitoring sound intensity at a frequency selected from the group consisting of about 125 hertz, about 250 hertz, about 500 hertz, and combinations thereof.

25. A method as claimed in claim 22 in which the processing zone advances downwardly through the fragmented mass and the step of drilling comprises drilling at least three substantially vertical bore holes extending through unfragmented formation adjacent the fragmented mass and the step of monitoring includes moving a sound transducer within each bore hole to a plurality of selected locations vertically spaced apart from each other for monitoring for sound produced in the retort.

26. A method for determining the locus of a processing zone advancing through a fragmented permeable mass of particles in a subterranean formation containing oil shale, the method comprising the steps of:

providing at least one cased bore hole extending into the fragmented mass; and monitoring within such a bore hole for sound produced in the retort.

27. A method as claimed in claim 26 in which the step of monitoring comprises monitoring sound intensity.

28. A method as claimed in claim 26 in which the processing zone is a combustion zone and the step of monitoring comprises monitoring sound intensity at a frequency characteristic of sound emitted by the burning of hydrocarbons.

29. A method as claimed in claim 26 in which the processing zone advances downwardly through the fragmented mass and the step of monitoring includes moving in such a bore hole a sound transducer to a plurality of selected locations vertically spaced apart from each other for monitoring for sound produced in the retort.

30. A method for determining the locus of a processing zone advancing downwardly through a fragmented permeable mass of particles in an in situ oil shale retort in a subterranean formation containing oil shale, the method comprising the step of monitoring for sound produced in the retort at at least three locations at substantially the same elevation.

31. A method for determining the locus of a processing zone advancing through a fragmented permeable mass of particles in a subterranean formation containing oil shale, the method comprising the steps of:

drilling at least three bore holes spaced apart from each other extending through unfragmented formation adjacent the fragmented mass; and monitoring for sound produced in the retort at a location within each of the bore holes in a plane substantially normal to the direction of advancement of the processing zone through the fragmented mass.

* * * * *

UNITED STATES PATENT AND TRADEMARK OFFICE

CERTIFICATE OF CORRECTION

PATENT NO. : 4,082,145

DATED : April 4, 1978

INVENTOR(S) : W. Brice Elkington

It is certified that error appears in the above-identified patent and that said Letters Patent are hereby corrected as shown below:

Column 3, line 59, "n" should be -- in --. Column 4, line 10, "as a combustion zone feed" should be deleted. Column 6, line 48, "decreses" should be -- decreases --. Column 7, line 28, "if" should be -- If --; line 40 "use" should be -- Use --. Column 11, line 29, change "volume" to -- intensity --. In the patent, after the abstract, please insert the following: " -- The government of the United States of America has rights in this invention pursuant to Cooperative Agreement No. EF-77-A-04-3873 awarded by the U. S. Energy Research and Development Administration. --"

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*